United States Patent [19]

Frazita

[11] 4,117,494

[45] Sep. 26, 1978

[54] ANTENNA COUPLING NETWORK WITH ELEMENT PATTERN SHIFT

[75] Inventor: Richard F. Frazita, Deer Park, N.Y.

[73] Assignee: Hazeltine Corporation, Greenlawn, N.Y.

[21] Appl. No.: 783,237

[22] Filed: Mar. 31, 1977

[51] Int. Cl.[2] ..... H01Q 3/26

[52] U.S. Cl. ..... 343/844; 343/100 SA; 343/854

[58] Field of Search ..... 343/778, 779, 854, 853, 343/100 SA, 844

[56] References Cited

U.S. PATENT DOCUMENTS

| | | | |
|---|---|---|---|
| 2,268,844 | 1/1942 | Polkinghorn | 343/854 |
| 3,803,625 | 4/1974 | Nemit | 343/778 |
| 3,964,066 | 6/1976 | Nemit | 343/854 |
| 4,041,501 | 8/1977 | Frazita et al. | 343/844 |

*Primary Examiner*—Alfred E. Smith
*Assistant Examiner*—David K. Moore

[57] ABSTRACT

In any array antenna system having a coupling network interconnecting a plurality of element groups, the coupling network is provided with phase adjustments to shift the angular location of the effective element radiation pattern. An effective technique for this phase adjustment in a microstrip coupling network makes use of a field altering structure positioned adjacent the microstrip.

7 Claims, 15 Drawing Figures

ANTENNA COUPLING NETWORK WITH ELEMENT PATTERN SHIFT

BACKGROUND OF THE INVENTION

This invention relates to array antenna systems and particularly to such systems wherein the required number of phase shifters or other active components is reduced by use of a coupling network interconnecting groups of antenna elements.

Prior U.S. patent application Ser. No. 594,934 entitled "Limited Scan Array Antenna Systems With Sharp Cutoff of Element Pattern," filed July 10, 1975 and now U.S. Pat. No. 4,041,501 which is assigned to the same assignee as the present invention, discloses an array antenna system wherein a coupling network interconnects groups of array antenna elements. Wave energy signals supplied at the input of any element group are coupled directly to the elements of that group and are also supplied through the coupling network to selected elements in the remaining element groups of the array. As a result, the array aperture is provided with an excitation, which closely approximates an ideal excitation to produce an effective element pattern wherein substantial radiation occurs only in a desired region of space. The specification and drawings of the prior application are incorporated into this application by reference.

FIG. 16 of the prior application discloses a technique for shifting the angular location of the effective element pattern of the array by providing linear increments of phase adjustment between the antenna elements and the coupling networks. As illustrated in FIG. 15 of that prior application, the effective element pattern can be displaced, for example, to one side of the broadside axis of the array. This prior technique for shifting the effective element pattern also angularly shifts the radiated array pattern by the same amount, since the phase adjustments are provided immediately adjacent to the radiating elements. As a result, if the pahse adjustments illustrated in FIG. 16 of the prior application are utilized in an array antenna such as shown in FIG. 6 of that application, both the antenna element pattern and main beam of the antenna are shifted in space. If phase shifters 13 of the antenna are set to radiate a beam in the broadside direction, the phase adjusting line lengths 74 will cause a shift in the direction of the antenna beam off the broadside axis by the same angular displacement as is given element pattern 77.

A similar effect results when the phase adjustment line lengths 75 are provided in an antenna having an input commutation switch, such as is shown in FIG. 7 of the prior application. In this case, the antenna radiates a pattern wherein the radiated frequency varies as a function of angle from the broadside axis of the array. The phase adjustments 75 will shift not only the effective element pattern, but also the frequency coding of the radiated signal.

FIG. 2 illustrates a microwave landing system environment wherein the present invention is particularly useful. A navigation antenna 52 of the type described in the referenced prior application is located adjacent an airport runway 54. Near the approach of runway 54, there is located uneven terrain 56. When an aircraft 58 is approaching runway 54, it may receive a signal 66 directly from antenna 52, and may also receive a signal 64 which has been reflected off the uneven terrain 56. In such an installation, it is particularly desirable to shift the location of the effective element pattern 60 of antenna 52 such that the radiation in the angular direction of the uneven terrain 56 is reduced, thereby to reduce navigation error resulting from multipath signal 64. In the event angular shifting of element pattern 60 is achieved by the method shown in FIG. 16 of the prior application, there will also be a shift in the direction of the antenna beam 62. If antenna 52 is used in a "scanning beam" landing system wherein a narrow antenna beam is moved through space at regular time intervals, the shift of antenna beam 62 will be manifested by an angular change in the direction of the antenna beam at any particular instant of time. In the event antenna 52 is used in a "Doppler" landing system, making use of a commutator arrangement such as shown in FIG. 7 of the prior application, antenna beam 62 represents the signal which is detected by a narrow bandwidth receiver, since antenna 52 radiates into the entire angular region defined by element pattern 60 with a radiation pattern wherein radiated frequency varies with angular direction. In a Doppler system, the prior art pattern shifting technique will result in a change in the angular frequency coding, thereby causing a frequency change in the radiated signal at any particular angle.

Since the prior art technique of changing the angular position of the effective element pattern results in a change in the frequency or time coding of the radiated signal, such modification to the antenna system to accommodate uneven terrain at a particular installation location results in additional complexity in the navigation equipment. Either the receiver in aircraft 58 must be advised of, and perform a correction calculation for, the resulting change in navigation coding or the coding mechanism of antenna 52 must be adjusted to correct for the change in the frequency or time coding of the radiated signal.

Another problem with the prior art technique of providing a phase shift adjustment at the inputs of the particular antenna elements is that such a phase adjustment eliminates the possibility of having uniform antenna element groups, each group consisting of elements, power divider, interconnecting transmission lines, couplers, and interconnecting networks, which could be produced as a modular unit. The element pattern steering technique of the prior application required different phase adjustment for each element. This eliminated the possibility of uniform modular construction. Further, the amount of phase adjustment could be very large for a large array.

It is therefore an object of the present invention to provide an array antenna system having an element pattern confined to a selected region of space wherein the angular location of the element pattern can be adjusted.

It is a further object of the present invention to provide such an antenna system wherein the adjustment of the angular location of the element pattern results only in an amplitude change of the array antenna pattern.

It is a still further object of the invention to provide such an antenna system wherein modular construction may be implemented to provide substantially identical element and network groups.

It is a still further object of the invention to provide phase adjustable microstrip transmission line useable in such antenna systems.

SUMMARY OF THE INVENTION

The present invention relates to an antenna system for radiating wave energy signals into a selected region of space wherein there is provided an aperture comprising a plurality of antenna element groups, a plurality of first coupling means, each for coupling supplied wave energy signals to the elements in a corresponding element group, and second coupling means interconnecting the first coupling means to cause wave energy signals supplied to any of the first coupling means to be additionally supplied to selected elements in the remaining element groups. In accordance with the invention, the second coupling means includes a plurality of phase adjustment means, each associated with one of the element groups. The phase adjustment means provides opposite sense phase adjustment for signals coupled in opposite directions with respect to the antenna aperture. By use of the phase adjustment means, the angular location of the selected region of space with respect to the aperture may be adjusted.

The second coupling means of the antenna system may comprise a transmission line interconnecting the plurality of first coupling means and having a first transmission line coupled to selected antenna elements and a second transmission line coupled to the remaining antenna elements. A convenient medium for the interconnecting transmission lines is microstrip. The required phase adjustment may be provided by use of field altering structure located adjacent to the microstrip thereby modifying the propagation constant of the microstrip to achieve phase adjustment.

For a better understanding of the present invention, together with other and further objects, reference is made to the following description, taken in conjunction with the accompanying drawings, and its scope will be pointed out in the appended claims.

DESCRIPTION OF THE PREFERRED EMBODIMENT

Figure 1:
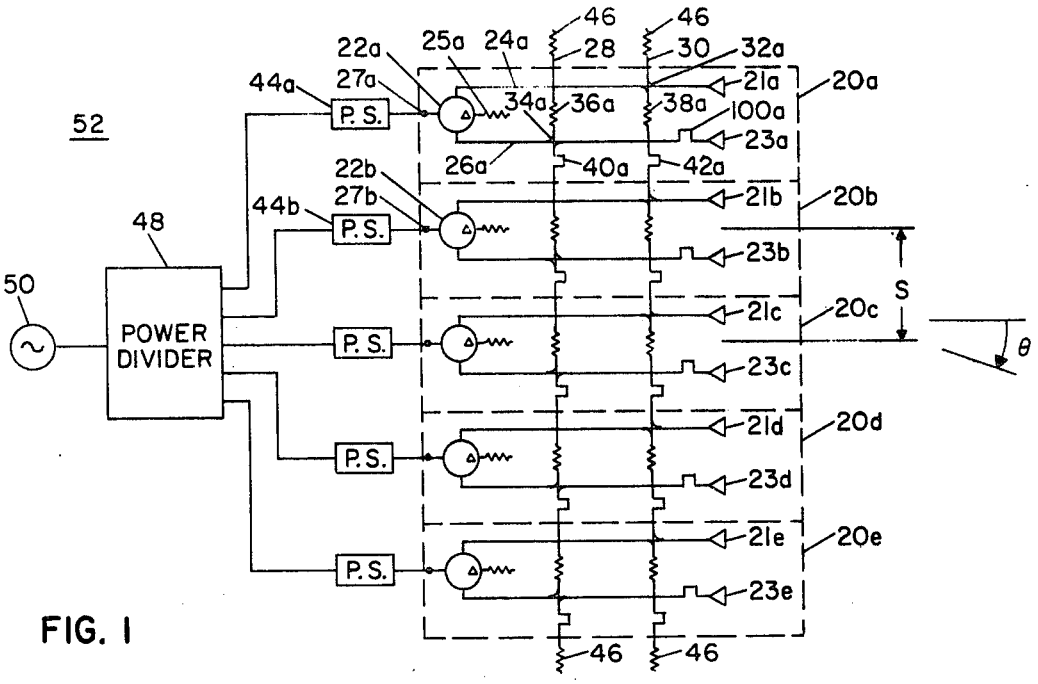
FIG. 1 is a schematic diagram of an antenna system in accordance with the present invention.
Figure 2:
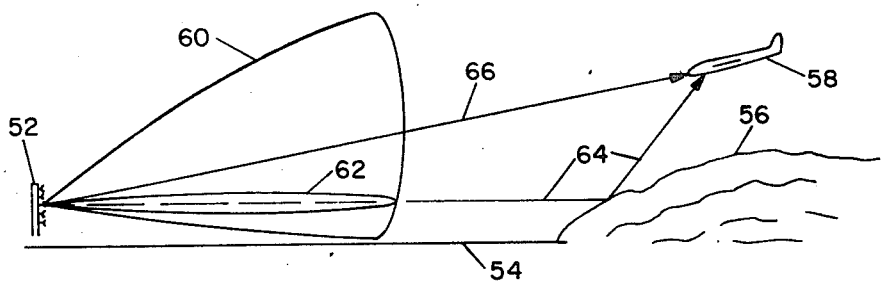
FIG. 2 illustrates a microwave landing system installation using the FIG. 1 antenna.
Figure 6:
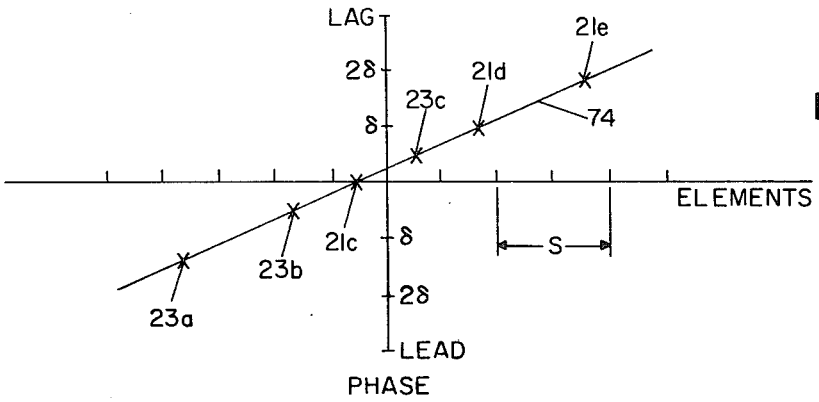
FIG. 6 is a graph illustrating the phase of the element aperture excitation of the FIG. 1 antenna.

FIG. 1 is a schematic diagram of an antenna system in accordance with the present invention, which closely corresponds to the schematic diagram of FIG. 6 in the above-referenced prior application. The FIG. 1 antenna includes a plurality of element groups with their associated coupling networks. Each element group 20 of the antenna system includes two antenna elements 21 and 23 which are connected to an element group input terminal 27 by hybrid power divider 22 and transmission lines 24 and 26. The difference terminal of hybrid 22 is terminated in a resistor 25. Transmission lines 24 and 26 interconnect the colinear terminals of hybrid 22 with elements 21 and 23, respectively.

In accordance with the teachings of the prior application, transmission lines 24 and 26 of each of element groups 20 are interconnected by coupling means comprising transmission lines 28 and 30. Transmission line 28 is coupled within each group 20 to transmission line 26 by coupler 34. Transmission line 30 is similarly coupled within each group 20 to transmission line 24 by coupler 32. Also in accordance with the teachings of the prior application, the ends of transmission lines 28 and 30 are terminated in resistors 46. The transmission lines include resistive loads 36 and 38 which are arranged between the points at which transmission lines 28 and 30 are coupled to transmission lines 24 and 26 in each of the adjacent element groups 20.

In accordance with the understanding of the prior application, hybrid power divider 22 and its associated output transmission lines 24 and 26 comprise a first coupling means, one for each element group 20, for coupling wave energy signals supplied at the input 27 to antenna elements 21 and 23 of each group 20. Also in accordance with the prior application, transmission lines 28 and 30 comprise second coupling means interconnecting the first coupling means so that signals supplied at the input 27 to any of the first coupling means are also supplied to selected elements in the remaining element groups of the array.

Figure 7:
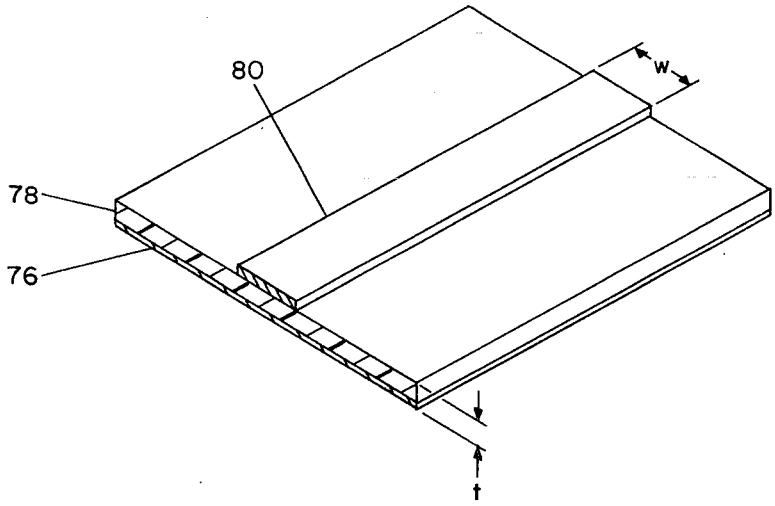
FIG. 7 is a cross-sectional perspective view of a microstrip transmission line.

Alternate networks for coupling wave energy signals to the array are shown in FIGS. 6 and 7 of the prior application. The network shown in FIG. 1, comprising oscillator 50, power divider 48, and phase shifters 44 corresponds to the network shown in FIG. 6 of the prior application. The network shown in FIG. 7 of the prior application includes an oscillator and a commutating switch for sequentially supplying wave energy signals to the inputs 27 of the element groups 20. The present invention is equally applicable to each of these alternate networks, which provide either radiation of a scanning narrow antenna beam or a broad radiation pattern wherein the frequency of radiation varies as a function of angular direction with respect to the array of antenna elements.

As indicated above, one object of the invention is to provide a special movement of the effective element pattern associated with each of the inputs 27 to the antenna groups of the FIG. 1 antenna system. Accordingly, there are provided in the FIG. 1 system phase adjustments 40, 42 and 100 in transmission lines 28, 30 and 26 associated with each of the element groups 20. In accordance with the invention, the phase adjustments in the transmission line 28 are of opposite sense to those in transmission lines 30 and 26. The selection of which phase adjustments will be positive is in accordance with the desired direction of element pattern shift. In the drawing of FIG. 1, phase adjustments 40, 42 and 100 are schematically illustrated as additional lengths of transmission line, but it should be understood that this can represent either a positive, or a negative phase adjustment. In order to illustrate the operation of the present invention, it will be assumed that phase adjustment 40 is negative, that is decreased transmission line length, while adjustments 42 and 100 are positive. The magnitudes of adjustments 40 and 42 are equal and twice that of phase adjustment 100.

Figure 5:
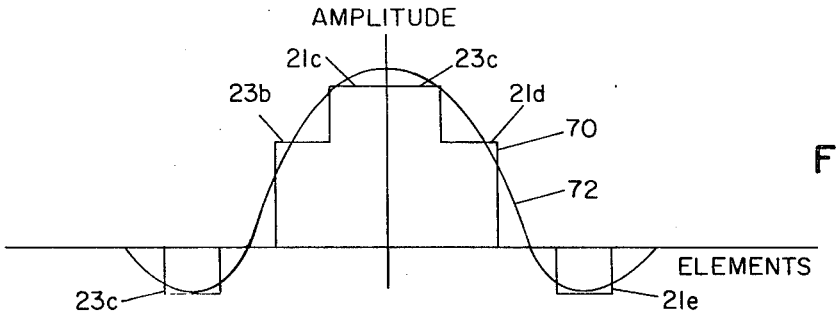
FIG. 5 is a graph illustrating the amplitude of the element aperture excitation in the FIG. 1 antenna.

In accordance with the prior application, wave energy signals supplied to the input 27c causes the antenna aperture to have the amplitude excitation 70 illustrated in FIG. 5, which approximates the ideal amplitude excitation 72, also shown in FIG. 5. In accordance with the prior application, transmission lines 28 and 30 have a transmission line length which is an odd multiple of a halfwave between couplers 32 and 34 in adjacent element groups. The effect of this selected transmission line length is to provide a 180° shift in the phase of wave energy signals coupled to elements in alternate element groups.

Without phase adjustment 100 signals supplied to the input 27c are supplied with equal amplitude and phase to elements 21c and 23c. A portion of the signal is also coupled from transmission line 26c onto transmission line 28 in an upward going direction in FIG. 1. The signal on transmission line 28 is coupled with reduced amplitude to element 23b. Without phase adjustment 40, the signal supplied to element 23b has the same phase as the signal supplied to elements 21c and 23c, since the 180° phase shift of transmission line 28 between groups 20c and 20b is effectively removed by the 90° phase shift of each of the couplers 34 through which the signal passes to reach element 23b.

The signal on transmission line 28 is also coupled to element 23a. Without phase adjustment 40, there is an additional 180° phase shift on transmission line 28 between module 20b and 20a, and the signal at element 23a will be 180° out of phase with the signals at elements 23b, 21c, and 23c. This phase relation is indicated by negative polarity of the excitation signal in FIG. 5.

Signals in transmission line 24c are similarly coupled by transmission line 30 to elements 21d and 21e to complete the opposite side of the aperture excitation illustrated in FIG. 5.

In accordance with the invention, it is desired that the effective element excitation illustrated in FIG. 5 be provided with the same linear phase variation along the aperture. It is also desired that this phase variation be provided in a manner which maintains the same absolute phase of the array excitation which is formed from the composite of the signals provided at the various inputs 27. Phase adjustments 40, 42 and 100, see FIG. 1, provide the necessary linear phase variation of the element aperture excitation without affecting the composite excitation in any other way, and therefore provide an angular shifting of the element pattern without changing the phase characteristics of the composite pattern resulting from the combination of all of the excitations provided to the inputs 27. As a result, if the antenna system is used in a scanning beam operation, the direction of the main beam is unchanged, but the amplitude of the main beam is modified for any angular direction in accordance with the change in the element pattern in that direction. Likewise, if the antenna is one which radiates a frequency coded pattern, the frequency coding remains unchanged, but the amplitude of radiation in any particular direction is modified in accordance with changes in the element pattern. Since phase adjustments 40 are negative, corresponding to decreased line lengths $\delta$ between corresponding portions of groups 20, the phase at elements 23b and 23a will lead the phase at element 23c by $\delta$ and $2\delta$, respectively. Since the phase adjustments 42 in transmission line 30 are positive, corresponding to increased transmission line lengths $\delta$, the phase at elements 21d and 21e will lag the phase at element 21c by $\delta$ and $2\delta$, respectively. The result will be an element pattern shift in the $+\theta$ direction shown in FIG. 1. Phase adjustment 100 provides an appropriate $\delta/2$ phase adjustment between elements 21c and 23c. The resulting phase of the aperture excitation 70 is illustrated in FIG. 6 and is an exact linear phase slope 74. Each of the phase adjustments 40 and 42 has magnitude $\delta$, which is twice that of adjustment 100 and the slope of line 74 therefore corresponds to a phase variation of $\delta$ for each distance S along the array, which corresponds to the spacings of element groups 20. Those skilled in the art can easily compute the required value of $\delta$ in accordance with the desired angular movement of the antenna element pattern. When pattern shape requirements are not critical phase adjustment 100 may be dispensed with while maintaining an approximation to the linear phase slope.

Figure 3:
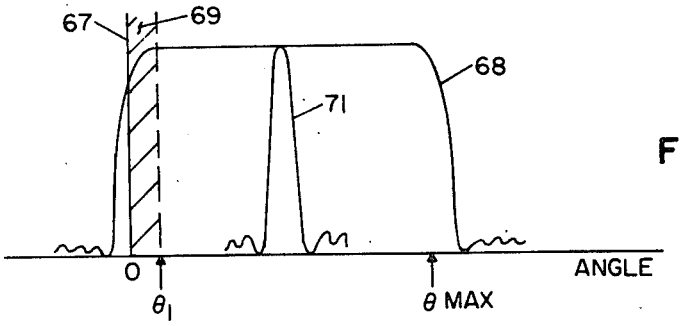
FIG. 3 is a graph showing the element pattern and array pattern of a prior art antenna.
Figure 4:
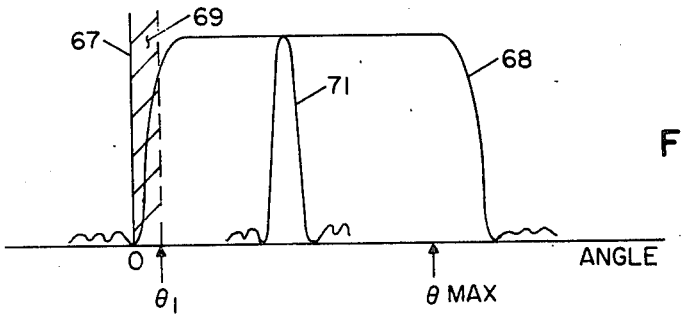
FIG. 4 is a graph showing the element pattern and array pattern of the FIG. 1 antenna.

A typical element pattern movement is shown in FIGS. 3 and 4. The figures show the element pattern 68 which is a function of the angle $\theta$ from the broadside axis 67 of the array. An angular region 69 corresponding to elevation angle $\theta_1$ is shown. Within angular region 69, there may be structures or terrain which will cause undesired multipath signals. The composite array pattern for the directional beam antenna shown in FIG. 1 is illustrated by narrow beam pattern 71. In accordance with the understanding of those skilled in the art, the relative amplitude of pattern 71 at any particular angle $\theta$ corresponds to tha amplitude of element pattern 68. FIG. 4 illustrates the effect of phase adjustments 40, 42 and 100 on element pattern 68. The element pattern has been moved by a desired amount in the positive direction of angle $\theta$ so that the amplitude of element pattern 68' is substantially reduced in the region 69 between broadside axis 67 and angle $\theta_1$. This shifting of the element pattern does not affect the angular location of array pattern 71, but merely reduces the amplitude of pattern 71 when scanned to region 69 wherein multipath radiation may occur.

When the antenna system is used to radiate a frequency coded pattern, phase adjustments 40, 42 and 100 likewise cause an angular shift in the radiated amplitude pattern without affecting the angular-frequency coding. Those skilled in the art will recognize that the present invention can be used to advantage in any of the alternate antenna network configurations shown in FIGS. 10, 13, and 14 of the referenced prior application.

MICROSTRIP EMBODIMENT

Figure 8:
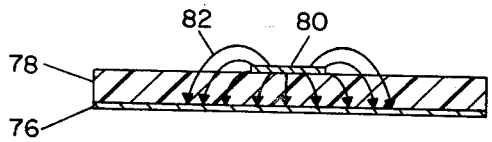
FIG. 8 is a cross-sectional view of the FIG. 7 transmission line.

The coupling networks of the FIG. 1 antenna, particularly interconnecting transmission lines 28 and 30, are advantageously formed using microstrip transmission line which is shown in FIG. 7. This transmission line includes a ground plane 76 over which there is a slab 78 of dielectric material. On the opposite side of dielectric slab 78 from ground plane 76, there is provided a conductive strip 80. Typically, ground plane 76 is a thin copper cladding on dielectric 78 and strip 80 is the remains of a similar cladding which has been largely removed by photoetching. Strip 80 and ground plane 76 form a two conductor transmission line whose impedance is determined by the thickness (*t*) and dielectric constant (K) of slab 78 and the width (*w*) of conductive strip 80. A typical 50 ohm transmission line may be formed using teflon-glass dielectric with a K off 2.2, a thickness (*t*) K of 0.020 inches and having a conductive strip with a width (*w*) of 0.050 inches. FIG. 8 is a cross-sectional view of the transmission line shown in FIG. 7 and illustrates the electric fields associated with a typical wave energy signal. A small fringing portion of the field 82 passes through the air adjacent the conductive strip before entering the dielectric material.

The inventor has discovered that by providing a structure that acts upon and alters the fringing electric field 82, it is possible to adjust the phase of wave energy signals on the microstrip transmission line. In accordance with the invention, both positive and negative phase adjustments can be achieved depending on the type of field altering structure used.

Figure 9:
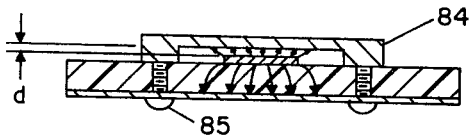
FIG. 9 is a cross-sectional view of a phase adjustable transmission line in accordance with the invention.

The cross-sectional view of FIG. 9 shows a field altering structure comprising conductive plate 84 which is arranged to be spaced a distance (*d*) from conductive strip 80. In order to accurately regulate spacing (*d*), conductive plate 84 has a cross-sectional configuration which includes a groove whose depth is selected in accordance with the required spacing (*d*). Screws 85 are provided to electrically connect conductive plate 84 to ground plane 76 of the transmission line.

Figure 14:
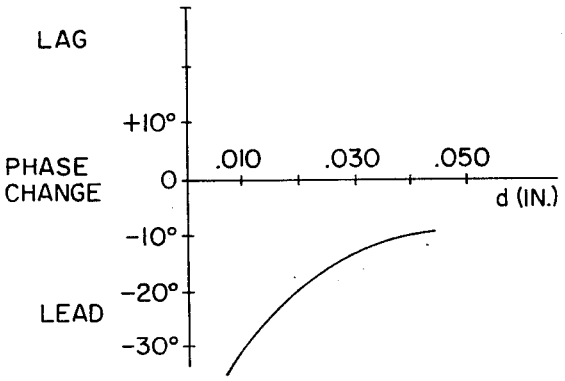
FIG. 14 is a graph showing phase as a function of separation (*d*) for the FIG. 9 transmission line.
Figure 12:
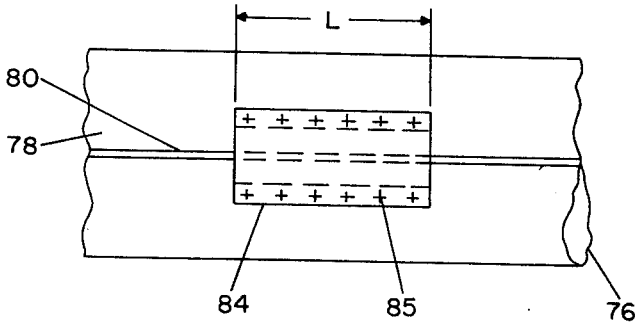
FIG. 12 is a planar view of the transmission line of FIG. 9.

Those skilled in the art will recognize that conductive plate 84 will draw some of the electric field emanating from conductive strip 80 through the region of air formed by the spacing (*d*) between conductive strip 80 and conductive plate 84. Since a major portion of the electric field will then be passing through air dielectric, the effective dielectric constant, and hence the propagation constant of the microstrip transmission line will be lower. It will also be recognized that as conductive plate 84 is arranged closer to conductive strip 80, the phase shifting effect will be increased. FIG. 14 is a graph showing an estimate of the phase shift at 5 GHz which might be realized by a conductive plate of the type shown in FIG. 9 with a length L of a half wave at the propagation constant of the transmission line. FIG. 12 is a planar view of such a conductive plate indicating the location of grounding screws 85 and the length L of the conductive plate.

Figure 15:
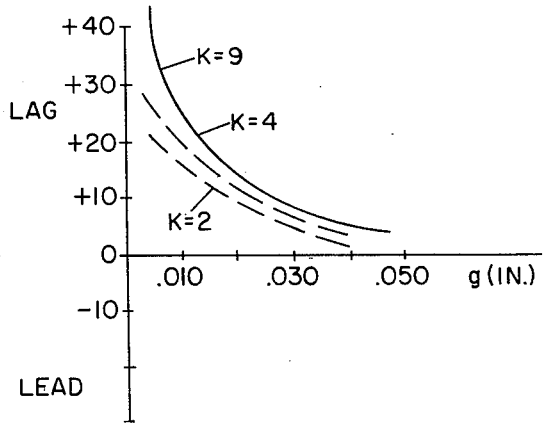
FIG. 15 is a graph showing phase as a function of separation (*e*) and dielectric constant for the FIG. 10 transmission line.
Figure 10:
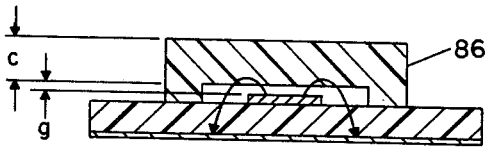
FIG. 10 is a cross-sectional view of another phase adjustable transmission line in accordance with the invention.
Figure 11:
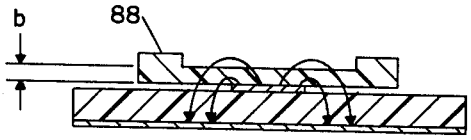
FIG. 11 is a cross-sectional view of another phase adjustable transmission line in accordance with the invention.

FIGS. 10 and 11 illustrate additional configurations wherein a field altering structure may be placed adjacent strip 80 to vary the propagation constant of the microstrip transmission line. In FIG. 10, a dielectric slab 86 of the same shape as conductive plate 84 is arranged with a spacing (*g*) away from conductive strip 80. Dielectric slab 86 intersects some of the fringing field from conductive strip 80 and since the slab has a higher dielectric constant than the air it replaces, there is an increase in the effective dielectric constant of the microstrip transmission line, and hence an increase in propagation constant. The effect of the FIG. 10 dielectric plate is therefore opposite the effect of the conductive plate of FIG. 9. The solid curve of FIG. 15 is a plot of measured phase shift at approximately 5 GHz, as a function of separation (*g*) for a half wave long plate of alumina with a thickness (*c*) of 0.125 inches, which has a dielectric constant (K) of 9. Also shown on the graph are the approximate phase shifts which would result from use of similar dielectric slabs with dielectric constants of 4 and 2. It is estimated that the effective phase shift is approximately proportional to $1/g\sqrt{K}$.

In FIG. 11, there is shown an alternate embodiment with a dielectric slab wherein the dielectric is placed in contact with conductive strip 80. In this event, phase adjustment may be achieved by trimming the thickness *b* of the dielectric slab 88.

Figure 13:
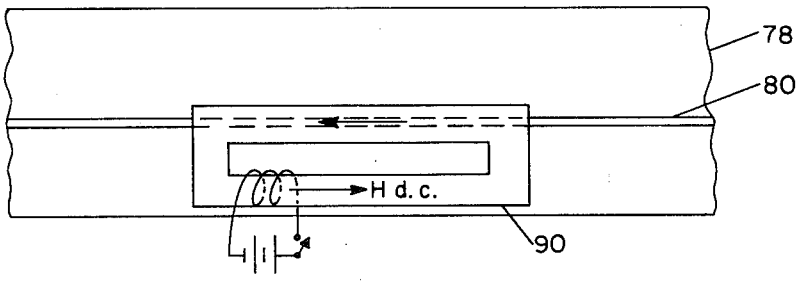
FIG. 13 is a planar view of another phase adjustable transmission line in accordance with the invention.

FIG. 13 shows another phase adjustable microstrip. A toroidal shaped ferrite slab 90 is placed over conductive strip 80. By inducing a direct current magnetic field in the ferrite slab to alter the permeability of the ferrite it is possible to provide small changes in the propagation constant of the transmission line resulting in phase adjustment. If the ferrite has the toroidal shape illustrated, the configuration will be "latching" and will retain the d.c. magnetic field after the battery current is disconnected. The configuration of FIG. 13 may be particularly useful in the antenna network of FIG. 1, since the ferrite material may provide both the resistive loss and phase adjustment required in transmission lines 28 and 30.

It will be evident to those familiar with such transmission lines that it is advantageous to select the length (L) of the field altering structure to be equal to a half wave length or an integral number of half wave lengths, so that the signal reflections occuring at each end of the field altering structure will be approximately self-cancelling.

Those familiar with microwave circuits will recognize that the phase adjusting structures of FIGS. 9 through 13 may be used in circuits other than that shown in FIG. 1. The structures are advantageously used in complex microstrip networks to trim out phase errors which may result from manufacturing tolerances and variations in dielectric materials or components.

While there has been described what are believed to be the preferred embodiments of the invention, those skilled in the art will recognize that other and further modifications may be made thereto without departing from the spirit of the invention, and it is intended to claim all such embodiments as fall within the true scope of the invention.

I claim:

1. In an antenna system for radiating wave energy signals into a selected angular region of space wherein there is provided an aperture comprising a plurality of antenna element groups, a plurality of first coupling means, each for coupling supplied wave energy signals to the elements in a corresponding element group, and second coupling means interconnecting said plurality of first coupling means to cause wave energy signals supplied to any of said first coupling means to be additionally supplied to selected elements in the remaining element groups, the improvement wherein:

said second coupling means includes a plurality of first phase adjustment means, each associated with one of said element groups, said phase adjustment means providing opposite sense phase adjustments for signals coupled in opposite directions with respect to said aperture, whereby the angular location of said selected region of space with respect to said aperture may be adjusted by adjustment of said phase adjustment means.

2. An antenna as specified in claim 1 wherein identical phase adjustment means are associated with all of said element groups.

3. An antenna system as specified in claim 1 wherein said each of said element group comprises first and second element modules each comprising one or more antenna elements, wherein each of said first coupling means comprises a power divider having first and second outputs coupled to said first and second element modules, wherein said second coupling means comprises a first transmission line coupled to each of said first power divider outputs and a second transmission line coupled to each of said second power divider outputs and wherein said phase adjustment means comprises different phase lengths in said first and second transmission lines.

4. An antenna system as specified in claim 3 wherein said first transmission line has a phase length, between corresponding portions of said first coupling means, which is a small amount ($\delta$) greater than an odd multiple of a half wave, and wherein said second transmission line has a phase length, between corresponding portions of said first coupling means, which is a small amount ($\delta$) less than an odd multiple of a half wave.

5. An antenna system as specified in claim 4 wherein there is additionally provided a plurality of second phase adjustment means, each associated with one of said first coupling means, and each having an amplitude ($\delta/2$).

6. An antenna system as specified in claim 1 wherein there is additionally provided a plurality of second phase adjustment means, each associated with one of said first coupling means.

7. An antenna system as specified in claim 5 wherein said first and second phase adjustment means are identical for each of said element groups.

* * * * *